US011357696B1

(12) United States Patent
Slattery

(10) Patent No.: US 11,357,696 B1
(45) Date of Patent: Jun. 14, 2022

(54) INTERCOURSE ASSEMBLY

(71) Applicant: Ernest Michael Slattery, San Antonio, TX (US)

(72) Inventor: Ernest Michael Slattery, San Antonio, TX (US)

( * ) Notice: Subject to any disclaimer, the term of this patent is extended or adjusted under 35 U.S.C. 154(b) by 495 days.

(21) Appl. No.: 16/455,461

(22) Filed: Jun. 27, 2019

Related U.S. Application Data

(60) Provisional application No. 62/715,393, filed on Aug. 7, 2018.

(51) Int. Cl.
*A61H 19/00* (2006.01)
*A47C 15/00* (2006.01)

(52) U.S. Cl.
CPC ..... *A61H 19/32* (2013.01); *A47C 15/008* (2013.01); *A61H 2201/0134* (2013.01); *A61H 2201/0157* (2013.01)

(58) Field of Classification Search
CPC ..... A61H 19/32; A61H 2201/0157; A61H 19/00; A61H 2201/0134; A61H 2201/0138; A61H 2201/169; A61H 2205/087; A47G 2009/1018; A47G 2009/002; A47C 15/008; A47C 31/113; A47C 27/005; A47C 7/386; B60N 2/60; F04D 25/088; F04D 29/005; F04D 29/646
USPC ..... 600/38
See application file for complete search history.

(56) References Cited

U.S. PATENT DOCUMENTS

| | | | | |
|---|---|---|---|---|
| 6,038,719 | A * | 3/2000 | Castagna | A47G 9/1045 5/636 |
| 6,360,387 | B1 * | 3/2002 | Everhart | A47C 20/027 5/490 |
| 7,993,262 | B2 * | 8/2011 | Cianfrani | A61H 19/44 600/38 |
| 10,251,808 | B1 * | 4/2019 | Theis | A61H 19/32 |
| 2006/0084933 | A1 * | 4/2006 | Aellis | A61H 19/44 604/342 |
| 2007/0214572 | A1 * | 9/2007 | Buben | A61H 19/00 5/630 |
| 2009/0188047 | A1 * | 7/2009 | Morse | A61H 1/0292 5/655.9 |
| 2013/0102842 | A1 * | 4/2013 | Zwezdaryk | A61H 19/44 600/38 |
| 2013/0221181 | A1 * | 8/2013 | Hamilton | F16M 13/00 248/523 |
| 2018/0104088 | A1 * | 4/2018 | Ishikawa | A61H 19/44 |
| 2019/0045932 | A1 * | 2/2019 | Turner | A47C 7/021 |

* cited by examiner

*Primary Examiner* — Kaylee R Wilson
(74) *Attorney, Agent, or Firm* — Plager Schack LLP; Mark H. Plager; Michael J. O'Brien

(57) ABSTRACT

An intercourse assembly is configured to enable human user to stimulate sexual intercourse. The apparatus is comprised of two cushions that each have a bullnose cutout on one side that is filled with a cushion bullnose made of a low-resilience polyurethane foam, such that when the cushions are attached, the two bullnose profile outlines are aligned. A formed pathway is made between the two cushion bullnoses to enable the user to simulate intercourse. A motor is attached to one of the bullnoses and configured to vibrate to enhance the user's enjoyment. Each cushion has an outer covering that features three hook and loop fasteners that enable the two cushions to attach to each other, as well as secure a washable liner to the apparatus through the use of two straps that each have two hook and loop fasteners on each end.

8 Claims, 3 Drawing Sheets

INTERCOURSE ASSEMBLY

RELATED APPLICATION

This application claims priority to provisional patent application U.S. Ser. No. 62/715,393 filed on Aug. 7, 2018, the entire contents of which is herein incorporated by reference.

BACKGROUND

The embodiments herein relate generally to devices that can be used for the gratification of humans.

With the sex doll industry becoming widespread and accepted, adult males are finding new ways of having sexual experiences with different products, including, among others, sex dolls. The advantage provided by sex dolls, unlike many other sexual masturbation aids, is that they offer the sensation of having real sex with another human. However, sex dolls come with certain disadvantages, such as cost, the difficulty of maintenance and cleaning, and the stigma attached to possessing such a product. Therefore, it is readily apparent that there is a need in the marketplace for a cost-effective, easy to clean, and discrete alternative to a sex doll.

SUMMARY

A two cushion apparatus is configured to enable a human user to simulate intercourse. The two cushion apparatus has a top cushion with a top cushion bullnose front and a top cushion soft foam filling on a top cushion bottom side. A bottom cushion is attached to the top cushion with a first hook and loop fastener forming a cavity therebetween, and further comprising a bottom cushion bullnose front and a bottom cushion soft foam filling on a bottom cushion top side. A strap is attached toward a front surface of the bottom cushion with a hook and loop fastener. An outer skin liner is looped around the strap to hold the outer skin liner bottom side to the bottom cushion. The outer skin liner is wrapped around the bottom cushion bullnose front and looped into the cavity and then wrapped around the front of the top cushion. Arranging the strap near a front of the top cushion holds the outer skin liner in place. The outer skin liner and the cavity form a thin horizontal slit at the top cushion bullnose front and the bottom cushion bullnose front. Upon an exterior object being inserted within the cavity expands the cavity to an exterior object cross sectional size.

In some embodiments, a bottom rear of the top cushion has attached fabric hook fasteners. In some embodiments, both sides of the top cushion have attached fabric hook fasteners near a front of the top cushion to allow the strap with fabric loop fasteners to wrap with around and attach to a top of the top cushion. In some embodiments, the top cushion has a foam insert with a bottom wedge cutout that mirrors a memory foam wedge that is inserted into a wedge cutout. In some embodiments, bottom rear of the bottom cushion has attached fabric loop fasteners that mirror a top cushion fabric hook fasteners.

In some embodiments, both sides of the bottom cushion have attached fabric hook fasteners near a front of the bottom cushion to allow the strap with fabric loop fasteners to wrap with around a bottom cushion bottom side and attach. In some embodiments, the bottom cushion has a foam insert with a top wedge cutout that mirrors a memory foam wedge that is inserted into a wedge cutout.

In some embodiments, the outer skin liner is made with vinyl or simulated leather and includes a centrally located pad made from silicone gel. In some embodiments, the outer skin liner is held to the bottom cushion using fabric loop fasteners on the strap. In some embodiments, the outer skin liner is looped in and out within the cavity between the top cushion and the bottom cushion to form a pocket. In some embodiments, the outer skin liner has a silicone gel pad located within a pocket formed between the top cushion and the bottom cushion. In some embodiments, the outer skin liner is held to the top cushion using a fabric loop fastener on the strap.

BRIEF DESCRIPTION OF THE FIGURES

The detailed description of some embodiments of the invention is made below with reference to the accompanying figures, wherein like numerals represent corresponding parts of the figures.

DETAILED DESCRIPTION OF CERTAIN EMBODIMENTS

Figure 1:
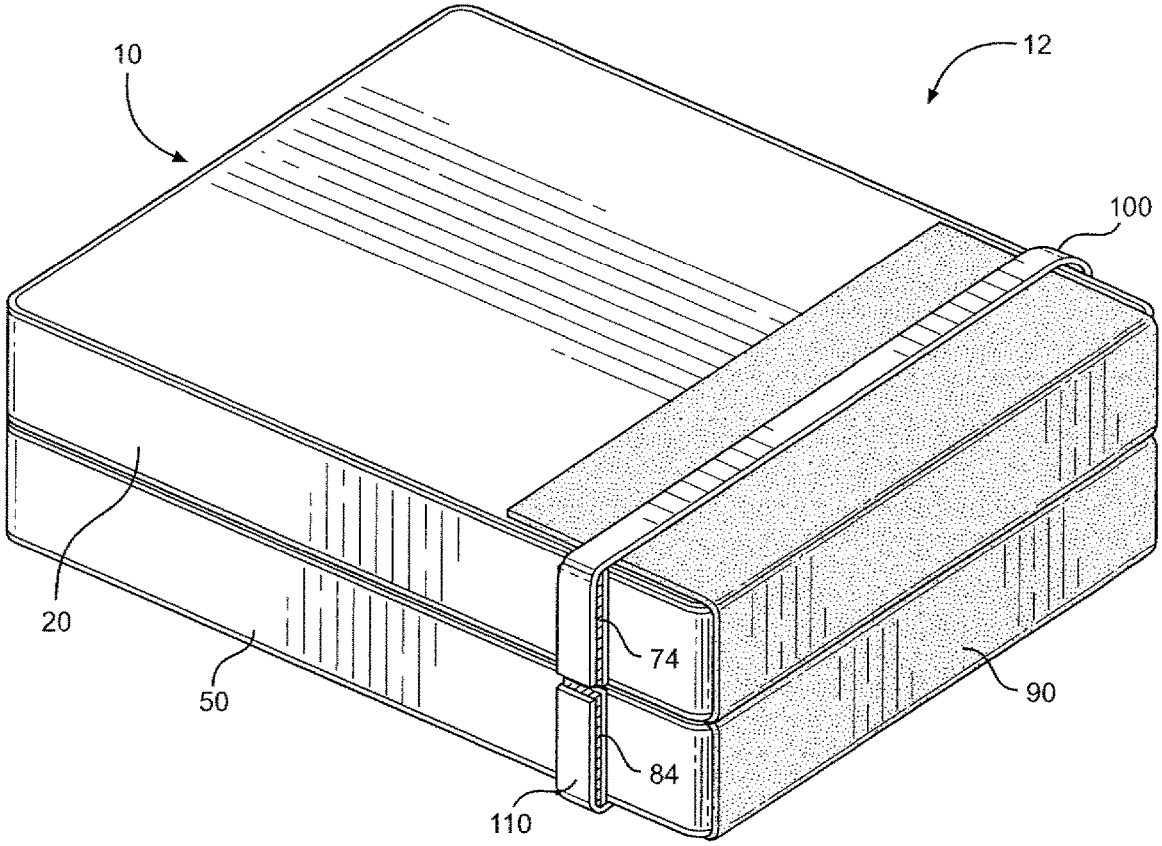
FIG. 1 shows a perspective view of one embodiment of the present invention.
Figure 2:
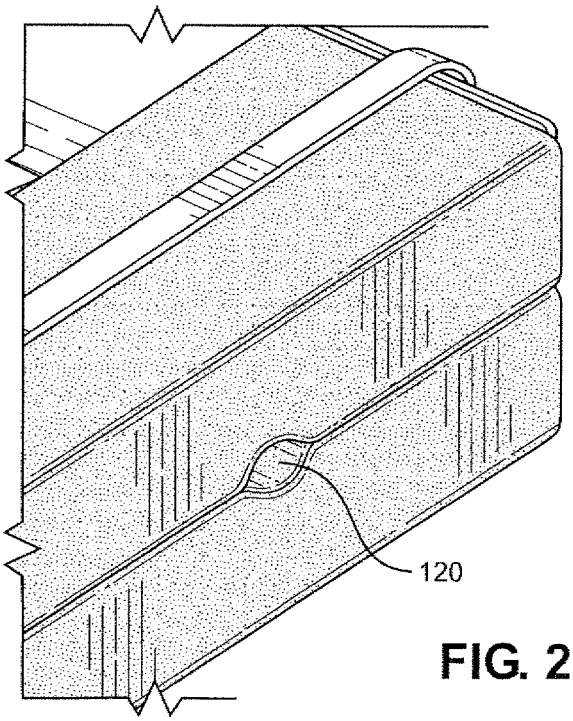
FIG. 2 shows a detail view of one embodiment of the present invention.
Figure 3:
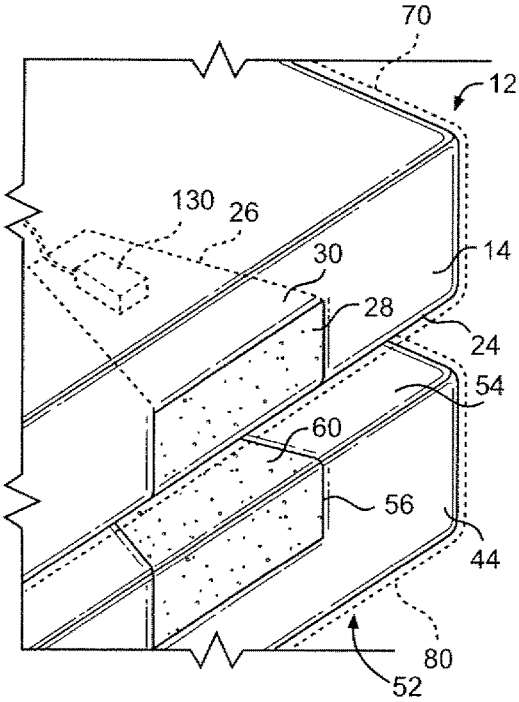
FIG. 3 shows a detail view of one embodiment of the present invention.
Figure 4:
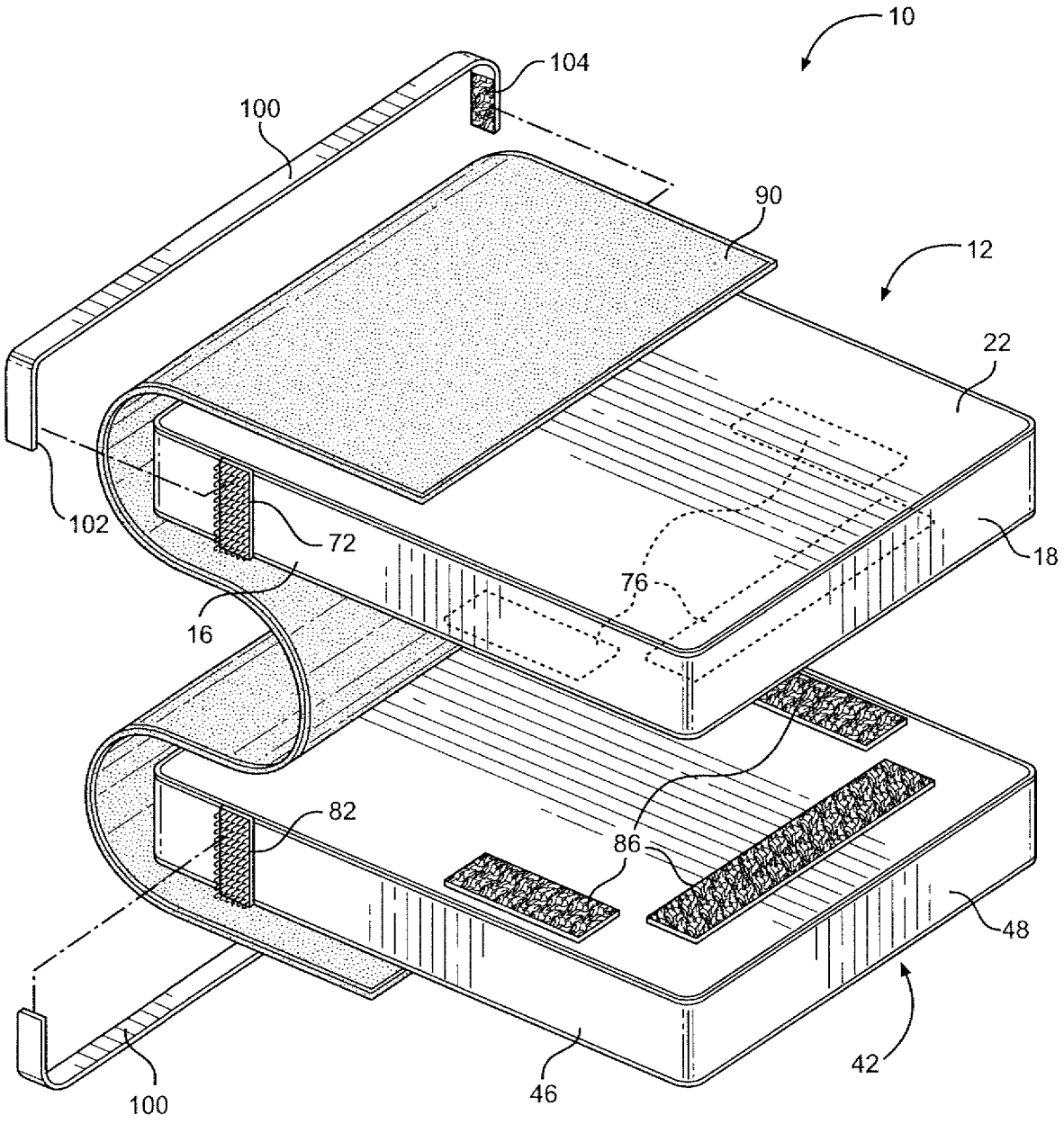
FIG. 4 shows an assembly view of one embodiment of the present invention.
Figure 5:
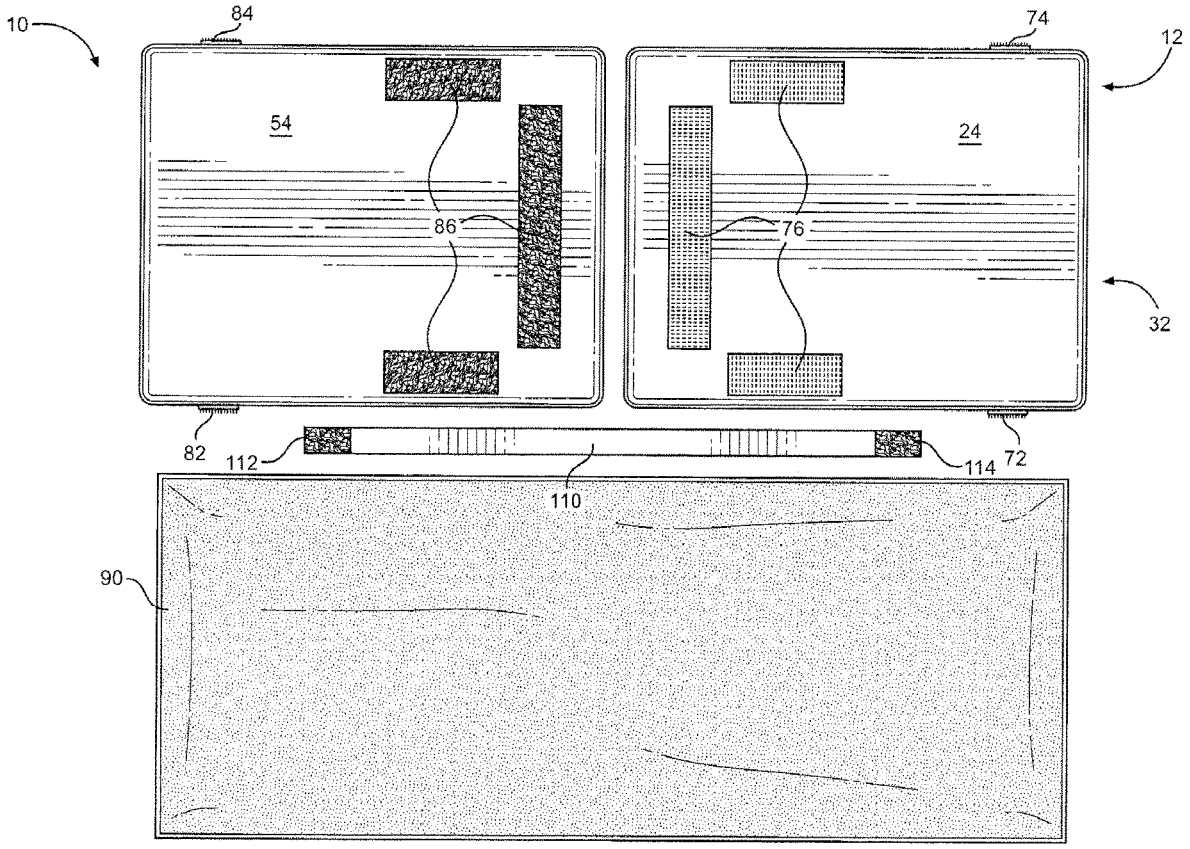
FIG. 5 shows components of one embodiment of the present invention.

By way of example, and referring to FIGS. 1-5, one embodiment of a two cushion apparatus 10 is configured to enable a human user to simulate intercourse. The two cushion apparatus 10 comprises a first cushion 12 made from a polyurethane foam arranged in a parallelepiped having a first cushion first side 14, a first cushion second side 16, a first cushion third side 18, a first cushion fourth side 20, a first cushion outer side 22 and a first cushion inner side 24.

A first bullnose cutout 26 is arranged through the first cushion inner side 24 and the first cushion first side 14. A first cushion bullnose 28 fills the first bullnose cutout 26 with a low-resilience polyurethane foam creating a first bullnose profile outline 30 on the first cushion inner side 24. A second cushion 42 is made from the polyurethane foam arranged in a parallelepiped having a second cushion first side 44, a second cushion second side 46, a second cushion third side 48, a second cushion fourth side 50, a second cushion outer side 52 and a second cushion inner side 54;

A second bullnose cutout 56, arranged through the second cushion inner side 54 and the second cushion first side 44;

A second cushion bullnose 58, filling the second bullnose cutout 56 with the low-resilience polyurethane foam creating a second bullnose profile outline 60 on the second cushion inner side 54; wherein the second bullnose profile outline 60 is aligned with the first bullnose profile outline 30;

A first cushion outer covering 70, surrounding the first cushion 12 and the first cushion bullnose 28 and further comprising a first cushion outer covering second side hook fastener 72, a first cushion outer covering fourth side hook fastener 74; a first cushion outer covering inner side hook fastener 76;

A second cushion outer covering 80, surrounding the second cushion 42 and the second cushion bullnose 58; and further comprising a second cushion outer covering second side hook fastener 82, a second cushion outer covering fourth side hook fastener 84; a second cushion outer covering inner side loop fastener 86; wherein the a first cushion outer covering inner side hook fastener 76 fastens to the second cushion outer covering inner side loop fastener 86 to join the first cushion 12 to the second cushion 42.

A washable liner 90 is arranged along the first cushion first side 14, the first cushion inner side 24, the first cushion second side 16, the second cushion first side 44, the second cushion inner side 54, and the second cushion second side 46 creating a pocket between the first cushion 12 and the second cushion 42.

A first strap 100 further comprises a first strap first loop fastener 102 and a first strap second loop fastener 104. The first strap first loop fastener 102 is joined to the first cushion outer covering second side hook fastener 72 and the first strap second loop fastener 104 is joined to the first cushion outer covering fourth side hook fastener 74. The first strap 100 joins the washable liner 90 to the first cushion 12.

A second strap 110 further comprises a second strap first loop fastener 112 and a second strap second loop fastener 114. The second strap first loop fastener 112 is joined to the second cushion outer covering second side hook fastener 82 and the second strap second loop fastener 114 is joined to the second cushion outer covering fourth side hook fastener 84. The second strap 110 joins the washable liner 90 to the second cushion 42.

A formed pathway 120 is arranged in the first cushion bullnose 28 and the second cushion bullnose 58. A vibrating motor 130 is attached to the first cushion bullnose 28, and configured to vibrate the first cushion bullnose 28. The vibrating motor 130 is configured to vibrate the first cushion bullnose 28.

As used in this application, the term "a" or "an" means "at least one" or "one or more."

As used in this application, the term "about" or "approximately" refers to a range of values within plus or minus 10% of the specified number.

As used in this application, the term "substantially" means that the actual value is within about 10% of the actual desired value, particularly within about 5% of the actual desired value and especially within about 1% of the actual desired value of any variable, element or limit set forth herein.

All references throughout this application, for example patent documents including issued or granted patents or equivalents, patent application publications, and non-patent literature documents or other source material, are hereby incorporated by reference herein in their entireties, as though individually incorporated by reference, to the extent each reference is at least partially not inconsistent with the disclosure in the present application (for example, a reference that is partially inconsistent is incorporated by reference except for the partially inconsistent portion of the reference).

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

Any element in a claim that does not explicitly state "means for" performing a specified function, or "step for" performing a specified function, is not to be interpreted as a "means" or "step" clause as specified in 35 U.S.C. § 112, ¶6. In particular, any use of "step of" in the claims is not intended to invoke the provision of 35 U.S.C. § 112, ¶6.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A two cushion apparatus configured to enable a human user to simulate intercourse, the two cushion apparatus comprising:

a top cushion with a top cushion bullnose front and a top cushion soft foam filling on a top cushion bottom side;

a bottom cushion attached to the top cushion with a first hook and loop fastener and forming a cavity therebetween, the bottom cushion comprising a bottom cushion bullnose front and a bottom cushion soft foam filling on a bottom cushion top side;

a first strap attached near the bottom cushion bullnose front with a second hook and loop fastener;

a second strap attached near the top cushion bullnose front with a third hook and loop fastener; and an outer skin liner looped around the first strap to hold the outer skin liner to the bottom cushion;

wherein the outer skin liner is wrapped around the bottom cushion bullnose front, looped into and out of the cavity to form a pocket, wrapped around the top cushion bullnose front, and held in place on the top cushion with the second strap;

wherein the outer skin liner and the cavity form a thin horizontal slit between the top cushion bullnose front and the bottom cushion bullnose front;

wherein upon an exterior object being inserted within the slit, the cavity expands to an exterior object cross sectional size.

2. The two cushion apparatus of claim 1, wherein the first hook and loop fastener includes fabric hook fasteners attached to the top cushion bottom side.

3. The two cushion apparatus of claim 2 wherein the first hook and loop fastener includes fabric loop fasteners attached to the bottom cushion, the fabric loop fasteners configured to mirror the top cushion fabric hook fasteners.

4. The two cushion apparatus of claim 1, further comprising a top cushion memory foam wedge; wherein the top cushion soft foam filling has a foam insert with a bottom wedge cutout that mirrors the top cushion memory foam wedge, the top cushion memory foam wedge is configured to be inserted into the bottom wedge cutout.

5. The two cushion apparatus of claim 1, further comprising a bottom cushion memory foam wedge; wherein the bottom cushion soft foam filling has a foam insert with a top wedge cutout that mirrors the bottom cushion memory foam wedge, the bottom cushion memory foam wedge is configured to be inserted into the top wedge cutout.

6. The two cushion apparatus of claim 1, wherein the outer skin liner is made with vinyl or simulated leather and includes a centrally located pad made from silicone gel.

7. The two cushion apparatus of claim 6, wherein the pad is located within the cavity formed between the top cushion and the bottom cushion.

8. The two cushion apparatus of claim 1, further comprising: a vibrating motor arranged within the top cushion bullnose front; wherein the vibrating motor is configured to vibrate the top cushion bullnose front.

* * * * *